US007240646B2

(12) United States Patent
Watanabe et al.

(10) Patent No.: US 7,240,646 B2
(45) Date of Patent: Jul. 10, 2007

(54) POWER PLANT INCLUDING AN INTERNAL COMBUSTION ENGINE WITH A VARIABLE COMPRESSION RATIO SYSTEM

(75) Inventors: Junya Watanabe, Saitama (JP); Masahiro Kuroki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 81 days.

(21) Appl. No.: 11/085,363

(22) Filed: Mar. 21, 2005

(65) Prior Publication Data

US 2005/0217618 A1 Oct. 6, 2005

(30) Foreign Application Priority Data

Mar. 31, 2004 (JP) ..... 2004-107421

(51) Int. Cl.
*F02B 75/04* (2006.01)
*F02D 15/02* (2006.01)

(52) U.S. Cl. ..... 123/48 B; 123/48 F

(58) Field of Classification Search ..... 123/48 B, 123/78 F

See application file for complete search history.

(56) References Cited

U.S. PATENT DOCUMENTS 7,007,640 B2 * 3/2006 Sakita ..... 123/78 F

FOREIGN PATENT DOCUMENTS

JP 58057040 A 4/1988

* cited by examiner

*Primary Examiner*—Noah P. Kamen
(74) *Attorney, Agent, or Firm*—Carrier, Blackman & Associates, P.C.; Joseph P. Carrier; William D. Blackman

(57) ABSTRACT

A power plant includes an internal combustion engine having a crankshaft to which a piston is connected and a variable compression ratio system for changing the position of the axis of rotation of the crankshaft. The power plant includes a transmission having a main shaft which is connected to the crankshaft through a first deceleration system. The variable compression ratio system includes a crankshaft holder, which rotatably supports the crankshaft and which is swingably supported on a main shaft, and a drive system which swings the crankshaft holder. Thus, the power plant retains unchanged the distance of shafts between the crankshaft and the main shaft, even when the combustion engine has a variable compression ratio system, by changing the position of the axis of rotation of the crankshaft.

17 Claims, 5 Drawing Sheets

FIG. 4
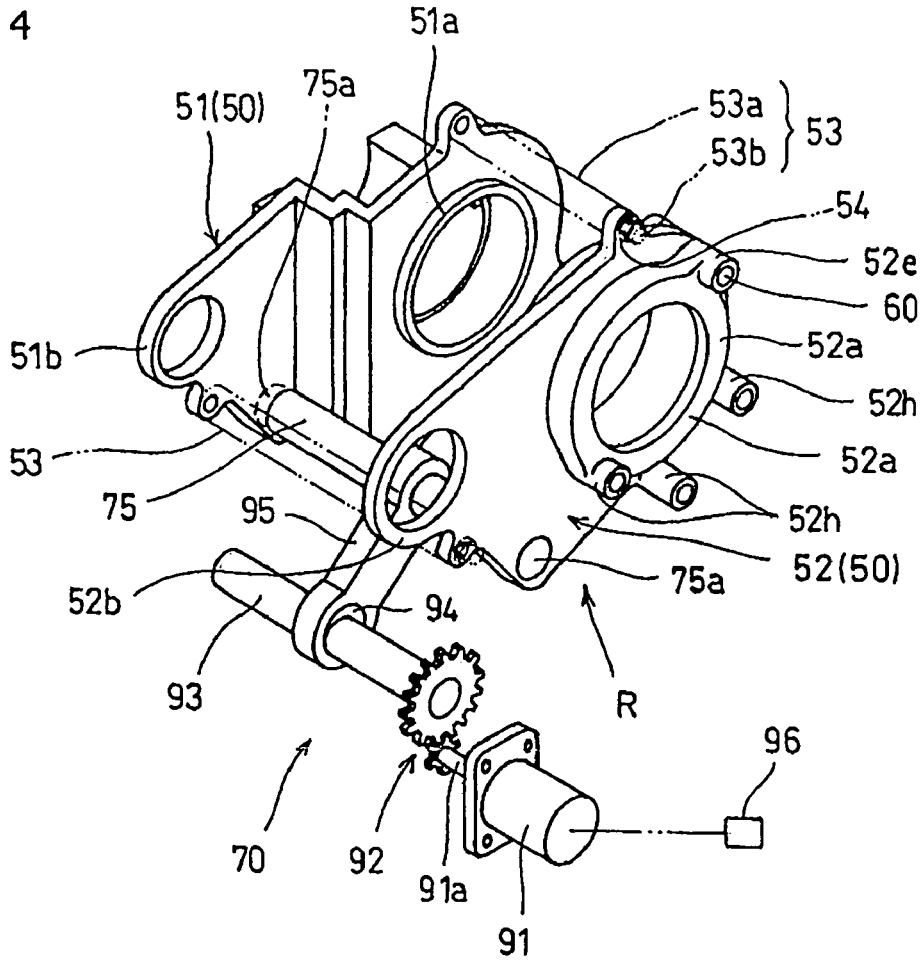
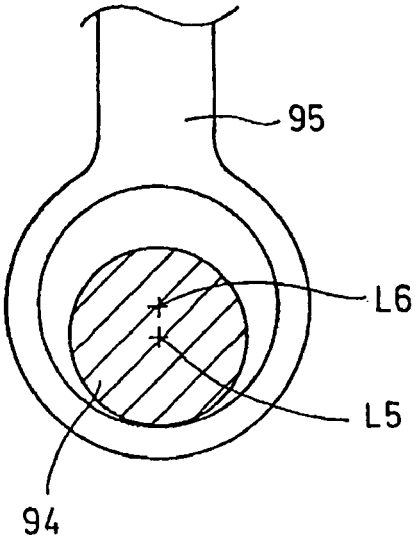
FIG. 5A
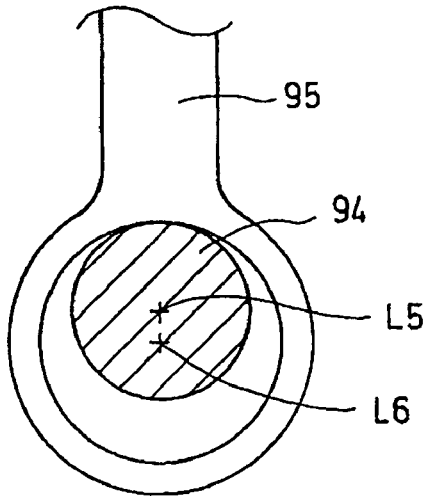
FIG. 5B

POWER PLANT INCLUDING AN INTERNAL COMBUSTION ENGINE WITH A VARIABLE COMPRESSION RATIO SYSTEM

CROSS-REFERENCE TO RELATED APPLICATIONS

The present invention claims priority under 35 USC 119 based on Japanese patent application No. 2004-107421, filed on Mar. 31, 2004. The subject matter of this priority document is incorporated by reference herein.

BACKGROUND OF THE INVENTION

1. Field of the Invention

The present invention relates to a power plant which includes an internal combustion engine with a variable compression ratio system which involves changing the position of the axis of rotation of a crankshaft, and which includes a transmission to which power of the crankshaft of the internal combustion engine is transmitted.

2. Background

A known internal combustion engine has a variable compression ratio system achieved by changing the position of the axis of rotation of a crankshaft in order to change a compression ratio. Such a system is disclosed in, for example, Japanese Patent Application Laid-open No. Sho 58(1983)-57040. In the internal combustion engine thereof, a crankshaft is rotatably supported on a cylinder block through an eccentric bearing. The eccentric bearing is activated into a rotational motion by a drive unit. As a result, the position of the axis of rotation is changed and the position of the top dead center is changed, hence changing the compression ratio.

In the meantime, in a power plant which includes a transmission with an input shaft whose axis of rotation is on a parallel with the axis of rotation of a crankshaft, when the position of the axis of rotation of the crankshaft is changed to change the compression ratio as in the above-described conventional technology, the shaft distance between the crankshaft and the input shaft is changed. As a result, it is difficult to make appropriate power transmission from the crankshaft to the input shaft. In addition, when power of the crankshaft is transmitted through a transmission which is formed by a gearing system, the shaft distance is changed so that the backlash between gears being engaged with each other is changed, causing gear noise to increase.

SUMMARY OF THE INVENTION

The present invention was made in light of the above-described problems. As for a power plant which includes a transmission and an internal combustion engine with a variable compression ratio system accomplished by changing the position of the axis of rotation of the crankshaft, a first object of the invention is to provide a power plant which retains unchanged a shaft distance between a crankshaft and an input shaft of a transmission.

A second object of the invention is to improve a reliability of supply of lubrication oil into an oil passage which is provided on the crankshaft whose axis of rotation is changed, or to improve a reliability of injection of lubrication oil which is directed to a piston, by making use of a crankshaft holder.

A third object of the invention is to simplify an oil passage which leads lubrication oil to an oil supply passage formed from an oil pump to the crankshaft holder, and to reduce an oil pressure loss.

A fourth object of the invention is to reduce an explosion load which acts on the input shaft through the crankshaft holder from the piston.

A fifth object of the invention to reduce vibration and noise due to the explosion load, by making use of an actuator which actuates the crankshaft holder.

A sixth object of the invention is further to reduce energy required for the actuator in order to retain the crankshaft holder at a set swing position.

A seventh object of the invention is to eliminate influences on electricity generated and ignition timing attributable to the change of position of the axis of rotation of the crankshaft using a simple structure.

According to a first aspect of the invention, there is provided a power plant which includes a crankshaft connected to a piston for reciprocating motion in a cylinder via a connecting rod; an internal combustion engine including a variable compression ratio system accomplished by changing a position of an axis of rotation of the crankshaft; and a transmission through a transfer mechanism including an input shaft to be connected to the crankshaft. The power plant is configured such that the axis of rotation of the crankshaft and an axis of rotation of the input shaft are mutually disposed in parallel, and the variable compression ratio system includes a crankshaft holder on which the crankshaft is rotatably supported and which is swingably supported on the input shaft and a driving system to swing the crankshaft holder.

According to the first aspect of the invention above, when the crankshaft holder is activated by the drive system, the crankshaft holder swings around the input shaft as a center of swing or swing axis, and the position of the axis of rotation of the crankshaft is changed. As a result, the position of the top dead center is changed, hence changing the compression ratio. At this moment, since the crankshaft holder swings with respect to the axis of rotation of the input shaft as a swing axis, even if the position of the axis of rotation of the crankshaft is changed to change the compression ratio, the distance of shafts between the crankshaft and the input shaft remains unchanged.

According to a second aspect of the invention, in addition to the first aspect, there is provided in the crankshaft holder an oil passage which supplies lubrication oil to a crankshaft oil passage provided on the crankshaft, or to an injection hole which is directed to a piston and through which lubrication oil is injected the piston.

According to the second aspect, since an oil passage, which supplies lubrication oil to the crankshaft oil passage, is provided to the crankshaft holder which supports the crankshaft, even if the position of the axis of rotation of the crankshaft is changed, lubrication oil is securely supplied to the crankshaft oil passage. Or, since the injection hole can be formed at a position relatively close to the piston, it is made possible to securely spray the lubrication oil injected through the injection hole.

According to a third aspect of the invention, in addition to the above aspects, there is provided in the crankshaft holder an oil supply passage which supplies lubrication oil into the oil passage and the injection hole, and an oil pump which discharges lubrication oil into the oil supply passage.

According to the third aspect, since both the oil supply passage and the oil pump are provided in the crankshaft holder, the oil passage can be simplified. The oil passage leads the lubrication oil discharged from the oil pump into the oil supply passage of the crankshaft holder which is in a swing motion, and further the oil passage can be shortened, hence reducing the oil pressure loss of the lubrication oil down to the oil supply passage.

According to a fourth aspect of the invention, in addition to the above aspects, there is provided a connecting portion connecting with the crankshaft holder in the drive system. The connecting portion is located at a position closer to a plane which contains a cylinder axis line of the cylinder and which is in parallel with the axis of rotation of the crankshaft, than a pivot portion of the crankshaft holder on the input shaft.

According to the fourth aspect, among forces acting on the crankshaft holder via the crankshaft from the piston, the connecting portion, which is closer to the cylinder axis line than the pivot portion of the input shaft, receives a larger load than the pivot portion, hence reducing the ratio of load acting on the input shaft.

According to a fifth aspect of the invention, in addition to the above aspects, the drive system includes an oil pressure actuator. The connecting portion is set in an output portion which applies a drive force on the crankshaft holder based on an oil pressure of operation oil of the oil pressure actuator. Accordingly, an explosion load is received by the operation oil acting on the output portion.

According to a sixth aspect of the invention, in addition to the above aspects, the drive system includes an actuator, a rotation shaft where an eccentric cam is provided, the eccentric cam being activated into a rotational motion by the actuator, and a linkage for linking the eccentric cam and the crankshaft holder; and the actuator swings the crankshaft holder in a range of rotation which includes a maximum lift position of the eccentric cam and a minimum lift position thereof.

According to the sixth aspect, at the maximum lift position of the eccentric cam and the minimum lift position thereof, the line of action of a load, which acts on the eccentric cam based on the explosion load acting on the eccentric cam, is placed almost on a plane which contains the axis of rotation of the rotation shaft and the axis of eccentricity of the eccentric cam, whereby there is almost no torque acting on the actuator due to the load.

According to a seventh aspect of the invention, in addition to the above aspects, a stator of an alternating current generator is fixed to the crankshaft holder, the alternating current generator including a rotor which is integrally and rotatably connected to the crankshaft.

According to the seventh aspect, the crankshaft holder swings, and consequently, even when the position of the axis of rotation of the crankshaft is changed, the stator and the rotor move together with the crankshaft holder. Hence, the space in the radial direction between the rotor and stator of the alternating current generator does not change.

According to the first aspect of the invention, even if the position of the axis of rotation of the crankshaft is changed to change the compression ratio, the distance of shafts between the crankshaft and the input shaft is remained unchanged, and power from the crankshaft to the input shaft is properly transmitted.

According to the second aspect of the invention, even if the position of the axis of rotation of the crankshaft is changed, since lubrication oil is securely supplied to the crankshaft oil passage, a good lubrication condition at a portion to be lubricated on the crankshaft is ensured. Or since the lubrication oil injected through the injection hole is securely sprayed on the piston, the cooling condition and lubrication condition are improved.

According to third aspect of the invention, since the oil passage, which leads the lubrication oil discharged from the oil pump into the oil supply passage of the crankshaft holder, is simplified, the structure of the oil passage is simplified, and the oil pressure loss of the lubrication oil being lead to the oil supply passage can be reduced, thereby further enhancing the effects of the invention.

According to fourth aspect of the invention, the drive system causes the ratio of load acting on the input shaft to be reduced, and thereby a smooth shifting capability of the transmission is ensured, and further, durability of a member supporting the input shaft is also improved.

According to fifth aspect, the explosion load is received by the operation oil acting on the output portion, thereby reducing the vibration/noise generated due to the explosion load.

According to the sixth aspect, at the maximum lift position of the eccentric cam or the minimum lift position thereof, there is almost no torque acting on the actuator, the torque being due to a load acting on the eccentric cam based on the explosion load acting on the eccentric cam, hence reducing energy required for retaining the crankshaft holder at a set swing position.

According to the seventh aspect, even if the position of the axis of rotation of the crankshaft is changed to change the compression ratio, the space in the radial direction between the rotor and stator of the alternating current generator does not change. Therefore, with a simple structure, it is made possible to eliminate an influence on ignition timing and generation of electricity due to the changing of the axis of rotation of the crankshaft.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

BRIEF DESCRIPTION OF THE DRAWINGS

FIG. 4 is a fragmentary-perspective view corresponding to that of FIG. 3 according to a second embodiment of the present invention.

FIG. 5(A) is a fragmentary-sectional views for FIG. 4 showing a state where an eccentric cam is located at a maximum lift position.

FIG. 5(B) is a fragmentary-sectional views for FIG. 4 showing a state where the eccentric cam is located at a minimum lift position.

DETAILED DESCRIPTION OF THE INVENTION

Embodiments of the present invention will be described hereinafter with reference to FIGS. 1 to 6.

Figure 1:
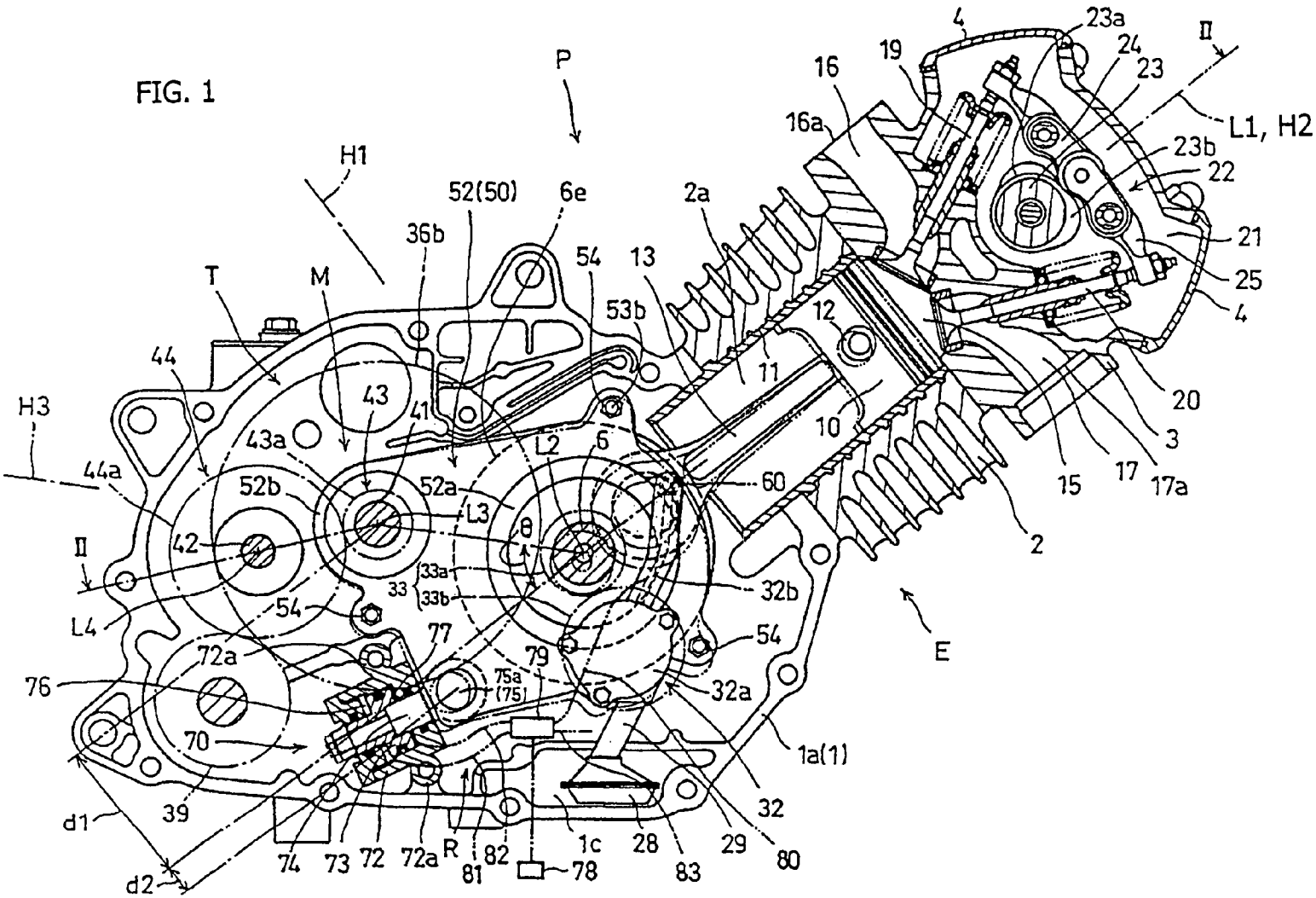
FIG. 1 is a diagrammatic-side view of a power plant when taking away a second casing of the crankcase in a first embodiment according to the present invention, and particularly for each part of a cylinder and a cylinder head, is a sectional view thereof taken along the line I—I in FIG. 2.
Figure 2:
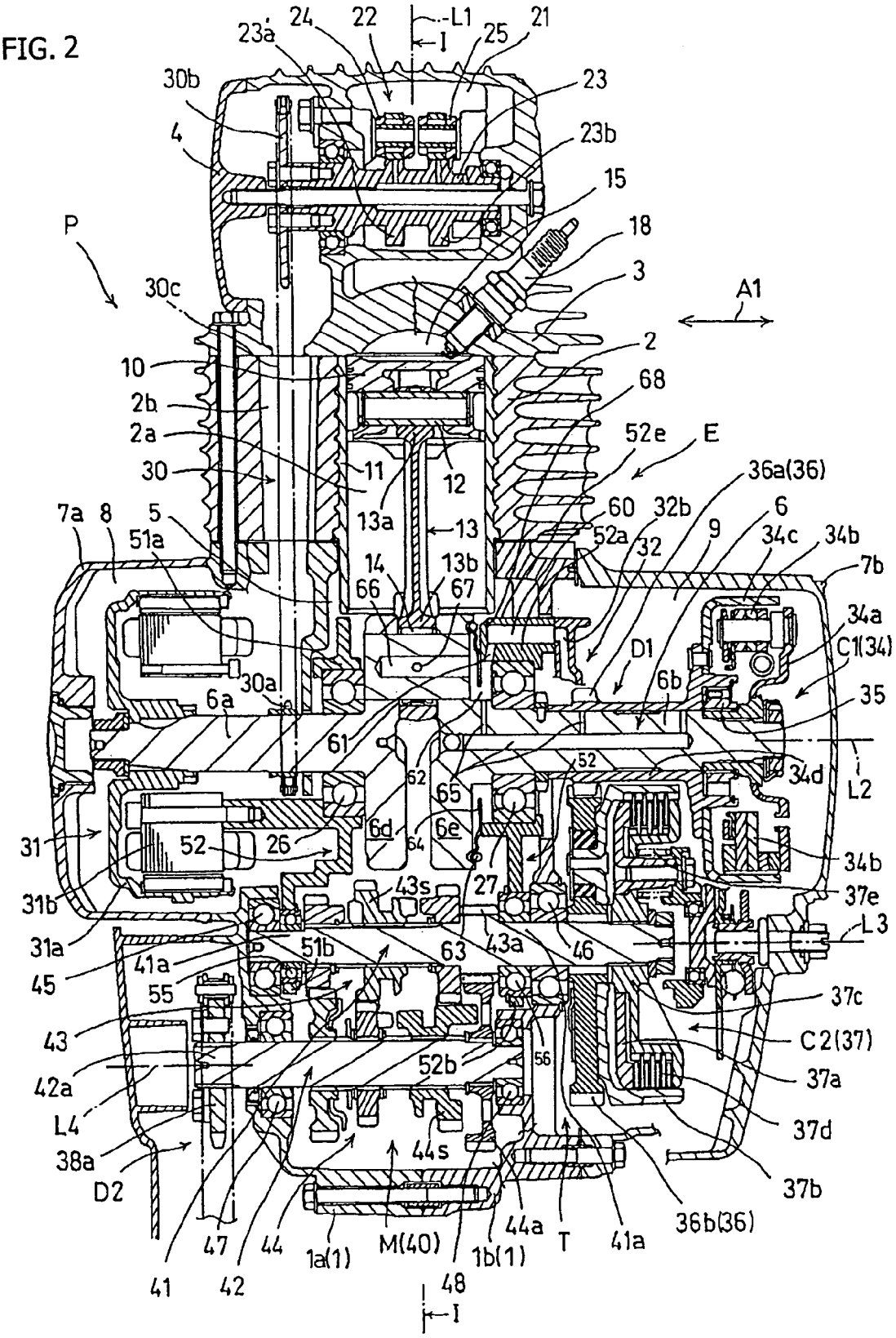
FIG. 2 is a sectional view taken along the line II—II in FIG. 1.
Figure 3:
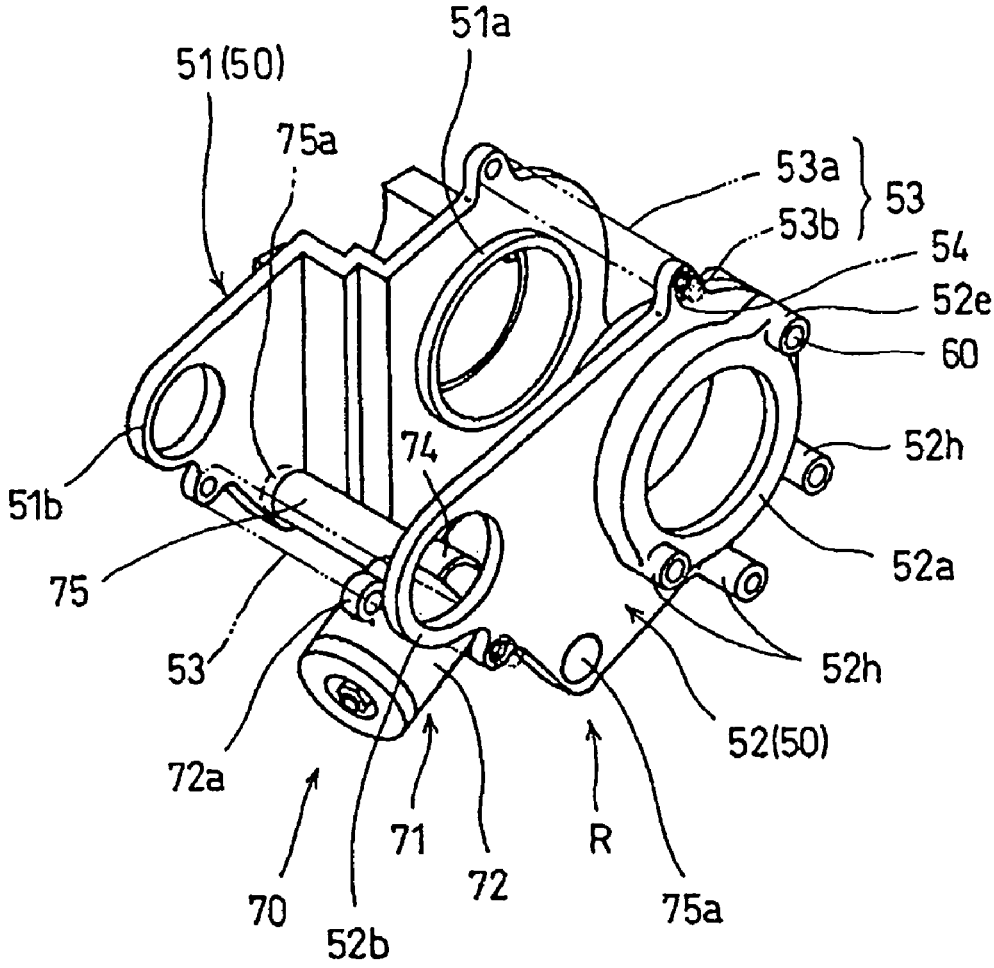
FIG. 3 is a fragmentary-perspective view of a variable compression ratio system of an internal combustion system in FIG. 1.

FIGS. 1 to 3 are directed to a first embodiment. First, referring to FIGS. 1 and 2, a power plant P according to the embodiment is mounted on a vehicle, and includes a power train system T and a spark ignition type single cylinder-four stroke internal combustion engine E. The power train system T, which transmits the power of a crankshaft 6 of the internal combustion engine E to a driving wheel, includes a starting clutch C1 which effects and interrupts the transmission of power from the internal combustion engine E to the power train system T. The power train system T includes a first deceleration system D1 which decelerates the rotation of the crankshaft 6 transmitted from the starting clutch C1, and transmits the rotation thereof thus decelerated to a shift clutch C2 and a transmission M. The power train system T further includes the shift clutch C2 which transmits the power of the crankshaft 6 to the transmission M, the power thereof being transmitted from the first deceleration system D1, to be effected or interrupted. The power train also includes the transmission M, which changes the rotational speed of the crankshaft 6, and a second deceleration system D2 which decelerates a rotation from the transmission M and transmits the rotation thus decelerated to the driving wheel. In a two-wheeled vehicle, the driving wheel is the rear wheel.

The internal combustion engine E may be of an air-cooled and single overhead camshaft (SOHC) type, and includes an engine body which is configured with a crankcase 1. Crankcase 1 also serves as a case for the power plant P, a cylinder head 3, and a plurality of head caps 4 connected to the cylinder 2. The cylinder 2, which is aligned with the cylinder axis line L1 inclined diagonally up forward from the crankcase 1 toward the forward direction of the vehicle, and the cylinder head 3 are sequentially stacked on the crankcase 1, and are integrally joined with the crankcase 1 using a bolt.

Incidentally, in this embodiment, the top and bottom, the front and back, and the left and right coincide with those of a vehicle.

The crankcase 1 is configured by a pair of first and second casings 1*a*, 1*b* having a separating plane on a plane which contains the cylinder axis line L1 and is orthogonal to the axis of rotation L2 of the crankshaft 6. In a crank chamber 5 formed by the crankcase 1, the transmission M and the crankshaft 6 of the internal combustion engine E are stored. A first storage chamber 8 is formed by the first casing 1*a*, which is the left casing, and a first cover 7*a* which is connected to the first casing 1*a*. A second storage chamber 9 is formed by the second casing 1*b*, which is the right casing, and a second cover 7*b* which is connected to the second casing 1*b*.

A piston 10, which reciprocates in a cylinder hole 2*a* formed in the cylinder 2, is slidably fitted into a cylinder sleeve 11 which is encased and cast in the cylinder 2. The piston 10 is connected to the crankshaft 6 through a connecting rod 13 which has a small end portion 13*a* that is pivotably mounted on a piston pin 12 and a large end portion 13*b* that is pivotably mounted on a crank pin 6*c* of the crankshaft 6 via a bearing 14.

In the cylinder head 3, there are formed a combustion chamber 15, which is opposite to a cylinder hole 2*a* in the direction of the cylinder axis line, and an intake port 16 and an exhaust port 17 both of which are open to the combustion chamber 15; and are further provided a spark plug 18 exposed to the combustion chamber 15, and a single intake valve 19 and a single exhaust valve 20 which respectively cause the intake port 16 and the exhaust port 17 to open or to close.

Meanwhile, in the internal combustion engine E, there are further provided an intake system, a fuel supply system, an exhaust system, a valve mechanism 22, and a variable compression ratio mechanism R. The intake system, which is fixed on a side surface of the cylinder head 3 to which an inlet 16*a* of the intake port 16 is open, leads the air which is sucked in from outside and measured by a throttle valve to the intake port 16. A fuel injection valve, which is the fuel supply system to supply liquid fuel into the sucked air, is fixed in the intake system, and injects fuel to the intake port 16. The exhaust system, which is fixed on the other side surface of the cylinder head 3 to which an outlet 17*a* of the exhaust port 17 is open, leads the exhaust gas which flows out from the combustion chamber 15 through the exhaust port 17 to outside the internal combustion engine E.

The valve mechanism 22, which is disposed in a valve chamber 21 formed by the cylinder head 3 and the head cap 4, performs open/close operations on the intake valve 19 and the exhaust valve 20 synchronous with the rotation of the crankshaft 6. Therefore, the valve system 22 includes a camshaft 23, which is rotated by power of the crankshaft 6 at a half of the rotational speed thereof, and an intake rocker arm 24 and an exhaust rocker arm 25 which are respectively swung by an intake cam 23*a* and an exhaust cam 23*b* formed on the camshaft 23; and the rotating intake cam 23*a* and exhaust cam 23*b* respectively performs open/close operations on the intake valve 19 and the exhaust valve 20 via the intake rocker arm 24 and the exhaust rocker arm 25.

Furthermore, the air, which has been sucked through the intake system, is sucked into the combustion chamber 15 from the intake port 16 through the intake valve 19 that is open in an intake stroke where the piston 10 moves downward, and is compressed in a state where it is mixed with fuel, in a compression stroke where the piston 10 moves upward. Mixed gas is ignited by the spark plug 18 and combusted in the termination of the compression stroke, and the piston 10, which is activated by the pressure of combustion gas in an expansion stroke where the piston moves downward, activates the crankshaft 6 into a rotational motion. The combustion gas is exhausted to the exhaust port 17 from the combustion chamber 15 as exhaust gas, via the exhaust valve 20 which is open in an exhaust stroke where the piston 10 moves upward, and is further exhausted to the outside through the exhaust system.

Referring to FIG. 3, the crankshaft 6 is supported, via a pair of main bearings 26 and 27, on a crankshaft holder 50 which is swingably supported on a main shaft 41 of a transmission M via a pair of bearings 55 and 56, in a pair of journal portions sandwiching a pair of crank webs 6*d* and 6*e* in the direction A1 of the axis of rotation L2 thereof (hereinafter, referred to as "axis direction A1"), the pair of crank webs 6*d* and 6*e* being connected to each other with a crank pin 6*c*. The crankshaft holder 50, which is stored in the crank chamber 5, is configured with first and second holders 51 and 52. First and second holders 51 and 52 are kept apart from each other by a certain distance in the axis direction A1. The first and second holders 51 and 52 are each formed by a plate-like member made of steel, for example, which is the same material as the forming material of the crankshaft 6. The first and second holders 51 and 52 are provided bearing portions 51*a* and 52*a*; and 51*b* and 52*b* which retain the main bearings 26, 27 and the bearings 55, 56. While the main bearings 26 and 27, and the bearings 55 and 56 are composed of ball bearings in this embodiment, alternatively, they may be composed of sliding bearings or of other roller bearings.

Referring to FIGS. 1 and 2, as for the crankshaft 6, there are provided, on one shaft end 6*a* protruded from the crank chamber 5, an alternating current generator 31 and a valve-use transmission system 30 disposed in the first storage chamber 8. Provided on the other shaft end 6*b* of the crankshaft 6, on a portion which protrudes from the crank chamber 5, are the starting clutch C1, the first deceleration system D1, and an oil pump-use transmission system 33 which activates an oil pump 32 fixed on the face of the second holder 52 at the side where the second storage chamber 9 is located.

The valve-use transmission system 30, which transmits power of the crankshaft 6 to the camshaft 23, includes a drive sprocket 30*a* fixed on the shaft end 6*a*, a cam sprocket 30*b* fixed on the camshaft 23, and a timing chain 30*c* which is spanned over the both sprockets 30*a* and 30*b* with the timing chain 30*c* passed through a transmission chamber 2*b* formed in the cylinder 2. The generator 31 includes a rotor 31*a*, which is rotatably and integrally connected to the shaft end 6*a*, and a stator 31*b* which is fixed on the first holder 51 with a bolt.

In order to activate the oil pump 32, the oil pump-use transmission system 33, which transmits power of the crankshaft 6 to the oil pump 32, includes a drive gear 33*a* which is rotatably and integrally connected to the shaft end 6*b*, and a driven gear 33*b* which is engaged with the drive gear 33*a* and which is rotatably and integrally connected to the oil pump 32. Further, the oil pump-use transmission system 33 is disposed between the second holder 52 and the oil pump 32 in the axis direction A1. Oil pump 32 may be composed of a trochoid pump.

The starting clutch C1 corresponds to a centrifugal clutch 34 which includes a drive plate 34*a* which is rotatably and integrally connected to the shaft end 6*b*, a centrifugal weight 34*b* which is swingably supported on the drive plate 34*a*, and a clutch outer 34*c* which is connected to the shaft end 6*b* via a one-way clutch 35. When the rotational speed of the crankshaft 6 exceeds a predetermined speed in the range of an extremely slow speed after the internal combustion engine E completely turns on, the centrifugal weight 34*b* is pushed against the clutch outer 34*c* by a centrifugal force, whereby the drive plate 34*a* and the clutch outer 34*c* rotate as a unit, hence the centrifugal clutch 34 comes to a connecting state.

The first deceleration system D1 includes a first drive gear 36*a* which rotates with the clutch outer 34*c* as a unit, and a first driven gear 36*b* which is engaged with the first drive gear 36*a* and is rotatably supported on the main shaft 41 serving as an input shaft of the transmission M.

The shift clutch C2 corresponds to a multiple disc-frictional type clutch 37 disposed in the second storage chamber 9. Clutch 37 comes to a connecting state or a disconnecting state in response to frictional forces generated in between clutch plates 37*d* consisting of a number of clutch plates, in a manner that a pressure plate 37*a*, which is operated by a clutch operation system, causes a pressure generated by an elastic force of a clutch spring 37 to act on or to be removed from the clutch plates 37*d* respectively fitted into a clutch inner 37*c* which are rotatably and integrally connected to the main shaft 41 and the clutch outer 37*b* which is rotatably and integrally connected to the first driven gear 36*b*.

A constant-mesh type gear transmission 40 configuring the transmission M includes the main shaft 41, which is rotatably and integrally connected to the clutch inner 37*c* and on which a group of input gears 43 are provided, and a counter shaft 42 serving as an output shaft on which a group of output gears 44 consisting of gears are provided, the gears being constantly and respectively engaged with the group of input gears 43. The main shaft 41 and the counter shaft 42 disposed in the crank chamber 5 are rotatably supported on the crankcase 1 which serves as a supporting member, in such a way that the axis of rotation L3 of the main shaft 41 and the axis of rotation L4 of the counter shaft 42 are in parallel with the axis of rotation of the crankshaft 6. Because of that, on the respective first and second casings 1*a* and 1*b*, the main shaft 41 is rotatably supported via a pair of bearings 45 and 46 consisting of ball bearings which are disposed at the outside of a pair of bearings 55, 56 and in the axis direction A1, and the counter shaft 42 is rotatably supported via a pair of bearings 47 and 48 consisting of ball bearings. By making use of gears 43*s* and 44*s* which serve as shifters through a shifting manipulation system, there is selected a gear which transmits the rotation of the main shaft 41 to the counter shaft 42, from among the group of input gears 43 and the group of output gears 44, whereby the rotational speed is changed and transmitted to the counter shaft 42.

The second deceleration system D2 is configured with a drive sprocket 38*a*, which is connected to a left shaft end of the one shaft end 42*a* of the counter shaft 42 protruded from the crank chamber 5. The second deceleration system D2 also includes a driven sprocket which is connected to a transmission chain 38*b* and a driven (rear) wheel of the vehicle.

Incidentally, a kick starter system includes a starter drive gear 39, which is operated by a rotation of the kick pedal. When the internal combustion engine E turns on, the rotation of the starter drive gear 39 is transmitted to the crankshaft 6 so as to be activated to rotate, through a first speed gear 44*a* rotatably supported on the counter shaft 42, a first speed gear 43*a* to rotate as unit with the main shaft 41, the clutch outer 37*b* of the shift clutch C2, the first deceleration system D1, the clutch outer 34*c* of the starting clutch C1, and the one-way clutch 35.

Therefore, the power of the crankshaft 6 is transmitted, when the starting clutch C1 becomes connected after turning on the internal combustion engine E, to the main shaft 41 via the first deceleration system D1 and the shift clutch C2, and further transmitted to the counter shaft 42 after changing the speed in the transmission M. Further, the power of the counter shaft 42 is transmitted to the driven/rear wheel through the second deceleration system D2 to activate the driven/rear wheel into a rotational motion.

Referring to FIGS. 1 to 3, the first and second holders 51 and 52 configuring the crankshaft holder 50 are connected with a predetermined space interposed therebetween, by using a plurality of connecting members 53 (indicated, in FIG. 3, by the chain double-dashed lines) which includes a spacer 53*a* that delimits the distance in the axis direction A1 between the first and second holders 51, 52, and a screw portion 53*b* that is formed at both ends of the spacer 53*a* and is screwed together with a nut 54. An oil pump 32, which is fastened on a plurality of fastening portions 52*h* of the second holder 52, sucks lubrication oil from a lubrication oil reservoir portion 1*c* formed at the bottom of the crankcase 1 through a suction tube 29 which is connected to the oil pump 32 via a strainer 28 and a flexible tube fitting; and discharges the lubrication oil thus sucked into an oil supply passage 60 formed in the second holder 52 via a discharge port 32*b*. Discharge port 32*b* is an oil passage formed in a pump housing 32*a*.

The oil supply passage 60 is configured with a hole formed in an oil passage forming portion 52*e* that is positioned in the vicinity of a portion being proximate to the cylinder hole 2*a* in the second holder 52. In the oil passage forming portion 52*e*, there is provided an oil passage 61 which leads the lubrication oil in the oil supply passage 60 to a crankshaft oil passage 65 provided on the crankshaft 6. The oil passage 61 is open to an oil chamber 62 which is formed between the second holder 52 and a disc-shaped crank web 6*e* that is proximate to the second holder 52 in the axial direction A1. The oil chamber 62 is formed in the midst of crankshaft 6, a bearing portion 52*a*, and a ring-shaped seal plate 64, and in the radially outward direction of the crankshaft 6 in such a manner that the ring-shaped seal plate 64, which is held by a ring 63 along a peripheral portion of the crank web 6*e*, is slidably contacted with the circumference of the bearing portion 52*a* which holds the second main bearing 27. The second main bearing 27 is a sealed bearing.

A crankshaft oil passage 65 is formed on the crankshaft 6. The crankshaft oil passage 65 includes an inflow port of which is open to the oil chamber 62. The oil passage 65 includes an outflow port, which is open to the circumferential surface of the crankshaft 6, in order to lead lubrication oil in between the circumferential surface of the crankshaft 6 and a tubular portion 34*d* of the clutch outer 34*c* fitted into the circumference of the crankshaft 6. Further, in the crank pin 6*c*, there is formed a pin oil passage 66, an inflow port of which is open to the oil chamber 62, which leads lubrication oil to the bearing 14 supporting the large end portion 13*b* via an oil opening 67 that is open to the circumferential surface of the crank pin 6*c*.

In the oil passage forming portion 52*e*, there is formed an injection hole 68 which directs to, and injects in the downward direction, the lubrication oil in the oil supply passage 60. As shown in FIG. 2, the injection hole 68 is located at a position almost same as that of a portion of the crank web 6*e* which is proximate to the cylinder hole 2*a*, when the piston 10 is positioned at the top dead center, and is located at a position almost same as that of the circumference of the cylinder hole 2*a*. Therefore, the injection hole 68 is located in a relatively closer position to the piston 10.

Incidentally, while not shown in the figure, lubrication oil at the discharge port 32*b* is supplied to the valve chamber 21, the valve system and the like, passing through in sequence the second holder 52, the connecting member 53, the first holder 51, a bearing portion holding the bearing 55 of the main shaft 41 in the first holder 51, a bearing portion holding the bearing 45 of the main shaft 41 in the first casing 1*a*, the first casing 1*a*, oil passages formed respectively in the cylinder 2 and the cylinder head 3.

The variable compression ratio system R, which changes the compression ratio of the internal combustion engine E, includes the crank shaft holder 50, which is swingably supported on a pair of pivot portions 41*a* of the main shaft 41, and a drive system 70, which swings the crank shaft holder 50 in response to a driving condition of the internal combustion engine E. The drive system 70 includes an oil pressure actuator 71 as an actuator, and a control portion which controls an operation of the oil pressure actuator 71.

The oil pressure actuator 71 includes a double acting type cylinder 72 which is fixed to the first casing 1*a* on a pair of fastening portions 72*a*, a piston 73, an output rod 74 which is connected to the piston 73 for connecting the piston 73 and the crankshaft holder 50, and a connecting member 75 on which the output rod 74 is pivotably mounted and which is connected to the first and second holders 51, 52 with a pair of connecting members 75*a*. There are formed a first oil pressure chamber 76 and a second oil pressure chamber 77 in between the cylinder 72 and the piston 73. Here, the piston 73, the output rod 74, and the connecting member 75 configure an output portion which applies on the crankshaft holder 50 a drive force based on an oil pressure of the operation oil of the oil pressure actuator 71.

The control portion includes an oil pressure circuit, where the discharging pressure of the oil pump 32 is an oil pressure source, and an electronic control unit 78. The oil pressure circuit includes an oil pressure control valve 79 which is disposed in the crank chamber 5; piping (not shown) which connects the discharge port 32*b* of the oil pump 32 and the oil pressure control unit 79, and forms an operation oil passage 80 that introduces a highly pressured lubrication oil as operation oil; piping (not shown) which forms a first oil passage 81 that connects the oil pressure control valve 79 and the first oil pressure chamber 76; piping (not shown) which forms a second oil passage 82 that connects the oil pressure control valve 79 and the second oil pressure chamber 77; and piping (not shown) which a drain passage 83 that drains the operation oil of the first and second oil pressure chambers 76 and 77 via the first and second oil passages 81 and 82. The electronic control unit 78 controls the oil pressure valve 79 in response to engine drive conditions such as the rotational speed of an engine and an engine load, and supplies/drains the operation oil of the first and second oil pressure chambers 76 and 77.

In each of the holders 51 and 52, the pivot portion 41*a* of the main shaft 41 and the connecting portion 75*a* of the connecting member 75 are disposed on the other side of the first plane H1 (see FIG. 1) with respect to the piston 10. Here, the first plane H1 is a plane which contains the axis of rotation L2 and is orthogonal to the cylinder axis line L1. The connecting portion 75*a* is disposed on the other side of the second plane H2 with respect to the pivot portion 41*a*, and is located at a position closer to the second plane H2 than the pivot portion 41*a*. Here, the second plane H2 is a plane which contains the cylinder axis line L1 and is in parallel with the axis of rotation L2. The second plane H2 is a plane containing the cylinder axis line L1 and the axis of rotation L2.

Furthermore, the oil pressure control valve 79 is controlled by the electronic control unit 78 to move between a first position and a second position. When highly pressured operation oil is introduced into the first oil pressure chamber 76 and thereby the output rod 74 occupies a first position where it advances, the crankshaft holder 50 occupies a first pivot position (indicated, in FIG. 1, by the solid line) at which the maximum compression ratio is achieved in the internal combustion engine E. When highly pressured operation oil is introduced into the second oil pressure chamber 77 and thereby the output rod 74 occupies a second position where it is most retracted, the crankshaft holder 50 occupies a second pivot position (indicated, in FIG. 1, by the chain double-dashed line) at which the minimum compression ratio is achieved in the internal combustion engine E. Further, the crankshaft holder 50 can occupy a pivot position in a continuous manner between the first pivot position and the second pivot position, in response to the pressures in the first and second oil pressure chambers 76 and 77, whereby the compression ratio can be set continuously in between the maximum compression ratio and the minimum compression ratio. When a pivot position of the crankshaft holder 50 is set, the pivot position at which a desired compression ratio is achieved, the oil pressure control valve 79 closes the first and second oil passages 81 and 82, and thereby the oil pressures in the first and second oil pressure chambers 76 and 77 are retained and the crankshaft holder 50 is retained at a set pivot position.

When an amount changed in the compression ratio is assumed to be the same, the crankshaft 6 and the main shaft 41 can cause the swing angle of the crankshaft holder 50 to be small and can cause to be small the range of movement of the output rod 74 of the oil pressure actuator 71 which swings the crankshaft holder 50, hence downsizing the oil pressure actuator 71, in such a way that the axis of rotation L2 and the axis of rotation L3, which becomes the swing axis of the crankshaft holder 50, are arranged such that a minor angle θ (see FIG. 1) formed by the second plane H2 and the third plane H3 be larger.

Next, the working and effects of the embodiment configured as described above are described.

The variable compression ratio system R of the internal combustion engine E includes the crankshaft holder 50, on which the crankshaft 6 is rotatably supported and which is swingably supported on the main shaft 41, and the drive system 70 which causes the crankshaft holder 50 to swing. Thus, when the crankshaft holder 50 is activated by the drive system 70, the crankshaft holder 50 swings with respect to the main shaft 41 so that main shaft 41 is a center of rotation. In addition, the position of axis of rotation L2 of the crankshaft 6 is changed, whereby the position of the top dead center of the piston 10 is changed relative to the cylinder 2, and the compression ratio is changed. At this time, since the crankshaft holder 50 swings with respect to the axis of rotation L3 of the main shaft as a swing axis, the distance of shafts, which is the distance between the axis of rotation L2 of the crankshaft 6 and the axis of rotation L3 of the main shaft 41, remains unchanged even if the axis of rotation L2 of the crankshaft 6 is changed in order to change the compression ratio, and transmission of power from the crankshaft 6 to the main shaft 41 is appropriately effected.

Incidentally, even if the compression ratio is changed, the distance of shafts between the crankshaft 6 and the main shaft 41 remain unchanged, and thereby, in the first deceleration system D1 which is configured by a gear system 36 that transmits power from the crankshaft 6 to the main shaft 41, an adequate amount of a backlash between the gears 36*a* and 36*b* being engaged with each other is maintained, hence preventing the operation of the variable compression ratio system R from causing increased gear noise and preventing the friction between the gears 36*a* and 36*b* from increasing.

There is provided the oil passage 61 in the crankshaft holder 50, which supplies lubrication oil to the crankshaft oil passage 65 that is provided on the crankshaft 6, and thereby, even if the position of the axis of rotation L2 of the crankshaft 6 is changed, the lubrication oil is securely supplied to the crankshaft oil passage 65, and a good lubricating condition is ensured between the crankshaft 6 and the tubular portion 34*d* of the clutch outer 34*c* of the starting clutch C1 which is the part to be lubricated on the crankshaft 6.

Moreover, in the crankshaft holder 50, there is provided the injection hole 68 which is directed to the piston 10 and through which lubrication oil is injected to the piston 10, whereby the position of the injection hole 68 can be made to relatively close to the piston 10. To be precise, the injection hole 68, which is formed in the oil passage forming portion 52*e* that is located in the vicinity of a portion proximity to the cylinder hole 2*a* in the second holder 52, is provided at a position relatively close to the piston 10, the injection hole 68 being located at a position almost same as that of a portion of the crank web 6*e* which is proximate to the cylinder hole 2*a*, when the piston 10 is positioned at the top dead center, and being located at a position almost same as that of the circumference of the cylinder hole 2*a*. Therefore, it is possible to securely spray the lubrication oil, which is injected through the injection hole 68, to the piston 10, hence improving the cooling and lubrication of the piston 10.

In the crankshaft holder 50, there are provided the oil supply passage 60, and the oil pump 32 which discharges lubrication oil into the oil supply passage 60, whereby the oil passage 61 communicates with the oil chamber 62, the oil supply passage 60 where the injection hole 68 is open, and the oil pump 32 are provided all together on the crankshaft holder 50. Accordingly, the lubrication oil discharged from the oil pump 32 is directly introduced from the discharge port 32*b* to the oil supply passage 60 of the crankshaft holder 50 which is swinging, whereby an oil passage, which leads lubrication oil discharged from the oil pump 32 to the oil supply passage 60, is made simple, the structure of oil passages in the crank chamber 5 is simplified, and further the oil passage from the oil pump 32 to the oil supply passage 60 can be shortened, thereby reducing the loss of oil pressure down to the oil supply passage 60. Consequently, securement of good lubrication at a part to be lubricated on the crankshaft 6, and cooling and lubrication of the piston 10 using the lubrication oil injected through the injection hole 68 are still more improved.

The oil chamber 62, where the lubrication oil from the oil supply passage 60 is introduced, is formed in between the second holder 52 and the crank web 6*e* which is proximate to the second holder 52 in the axis direction A1. The lubrication oil from the oil chamber 62 is introduced into the crankshaft oil passage 65 and the pin oil passage 66. As a result, the lubrication oil from the oil chamber 62, where a large amount of highly pressured lubrication oil is stored, can be supplied to the crankshaft oil passage 65 and the pin oil passage 66. It is thereby possible to supply a steady amount of highly pressured lubrication oil into the oil passages 65 and 66, and further possible to sufficiently supply the lubrication oil flowing out of the bearing 14 to the transmission M and the power train device T.

The crankshaft holder 50 and the connecting portion 75*a* in the drive system 70 are located at positions closer to the second plane H2 than the pivot portion 41*a* of the main shaft 41 for the crankshaft holder 50. Thus, the distance d2 between the cylinder axis line L1 and the center axis line of the connecting portion 75*a* is smaller than the distance d1 between the cylinder axis line L1 and the axis of rotation L3. Accordingly, among the forces acting on the crankshaft holder 50 via the crankshaft 6 from the piston 10, the connecting portion 75*a* of the connecting portion 75 of the oil compression actuator 71, which is located at a position closer to the cylinder axis line L1 than the pivot portion 41 of the main shaft 41, receives a larger load than the pivot portion 41*a*, whereby the ratio of loads acting on the main shaft 41 is reduced. Therefore, a smooth shifting capability of the transmission M is secured. Further, improved durability of the bearings 55, 56, being the members to support the crankshaft holder 50, and the bearings 45, 46 being the members to support the main shaft 41, is achieved.

The connecting members 75 where the connecting portion 75*a* is provided configures an output portion which applies on the crankshaft holder 50 a drive force based on the oil pressure of the operation oil of the oil pressure actuator 71 along with the piston 73 and the output rod 74. Accordingly, an explosion load is received the operation oil in the first oil pressure chamber 76 which acts on the piston 73 via the connecting member 75 and the output rod 74, hence reducing the vibration/noise generated due to the explosion load.

On the crankshaft holder 50, there is fixed the stator 31*b* of the alternating current generator 31 which includes the rotor 31*a* that is rotatably and integrally connected to the crankshaft 6. Accordingly, even if the crankshaft holder 50 is swung and thus the position of the axis of rotation L2 of the crankshaft 6 is changed, the stator 31*b* and the rotor 31*a* move together with the crankshaft holder 50, whereby the space in the radial direction between the rotor 31*a* and the stator 31*b* of the alternating current generator 31 does not change. Therefore, with a simple structure, it becomes possible to eliminate the influence of a change of the position of the axis of rotation L2 of the crankshaft 6 on ignition timing and production of electricity.

Since the crankshaft holder 50 is made of the same material as the forming material of the crankshaft 6, there occurs almost no change in the distance of shafts due to thermal expansion between the crankshaft 6 and the main shaft 41. This also prevents an increase in the gear noise of the gears 36*a*, 36*b* and an increase in the friction between the gears 36*a* and 36*b*.

Incidentally, the shift clutch C2 is provided on the main shaft 41 which is the swing center axis of the crankshaft holder 50, and thus is not influenced by the pivoting of the crankshaft holder 50, thereby simplifying the clutch operation system.

Next, a second embodiment of the present invention is described with reference to FIGS. 4 and 5. The difference between the first embodiment and the second embodiment mainly lies in the drive system of the variable compression ratio system R. Otherwise, both embodiments have basically the same configurations. Therefore, for the same parts, explanations are omitted or simplified, and are made focused mainly on the differences thereof. Further, the same numerals are used, as needed, for members same as or corresponding to those used in the first embodiment.

Referring to FIG. 4, a drive system 70 includes an electric motor 91 which serves as an actuator to generate a torque, a transmission portion for transmitting the torque of the electric motor 91, an output portion for applying on a crankshaft holder 50 a drive force based on the torque of the electric motor 91, and a control portion. The transmission portion includes a deceleration system 92 having a pair of gears to decelerate the rotation of an output shaft 91*a* of the electric motor 91, and a rotation shaft 93 which is rotatably supported on a crankcase 1 and which is activated into a rotational motion via the deceleration system 92. The output portion includes an eccentric cam 94 having a cam surface consisting of a cylinder surface as a rotation cam, a connecting member 75, and a linkage 95 which is pivotably mounted on the eccentric cam 94 and the connecting member 75 to connect the eccentric cam 94 and the crankshaft holder 50. Further, the control portion includes an electronic control unit 96, which controls the number of times of rotation of the electric motor 91 and the direction of rotation thereof in response to an engine drive condition, and which sets the ranges of rotation of the rotation shaft 93 and the eccentric cam 94.

Referring to FIGS. 5A and 5B, in this embodiment, the range of rotation of the eccentric cam 94 is set to a range of rotation which includes the maximum lift position where the distance between the connecting member 75 and the axis of rotation L5 of the rotation shaft 93 becomes maximum; and the minimum lift position where the distance between the connecting member 75 and the axis of rotation L5 of the rotation shaft 93 becomes minimum.

Meanwhile, the electric motor 91 is controlled with the electronic control unit 96; and when the eccentric cam 94 occupies the position of the maximum lift position, the crankshaft holder 50 occupies the first swing position, and when the eccentric cam 94 occupies the position of the minimum lift position, the crankshaft holder 50 occupies the second swing position. In response to the rotation of the electric motor 91, the crankshaft holder 50 can occupy any swing position in a continuous manner in between the first swing position and the second swing position, as in the case of the first embodiment.

Thus, the compression ratio can be continuously set between the maximum compression ratio and the minimum compression ratio. When a swing position of the crankshaft holder 50 is set where a desired compression ratio is achieved, the electric motor 91 retains the pivot position set for the crankshaft holder 50.

Moreover, when the eccentric cam 94 is at the maximum lift position and the minimum lift position, on the basis of an explosion load that acts on the crankshaft holder 50 via the crankshaft 6 from the piston 10, the line of action of a load which acts on the eccentric cam 94 through the linkage 95 is located approximately on a plane which contains the axis of rotation L5 of the rotation shaft 93 and the axis L6 of eccentricity.

The second embodiment brings about the operation and effects similar to those in the first embodiment, and further brings about the following operation and effects.

The drive system 70 includes the rotation shaft 75 where the eccentric cam 94 being rotated by the electric motor 91 is provided, and the linkage 95 for linking the eccentric cam 94 and the crankshaft holder 50. The electric motor 91 causes the crankshaft holder 50 to swing in the range of rotation which includes the maximum lift position of the eccentric cam 94 and the minimum lift position thereof. Accordingly, when the eccentric cam 94 is at the maximum lift position and the minimum lift position, the line of action of a load, the load acting on the eccentric cam 94 based on an explosion load which acts on the eccentric cam 94, is located approximately on a plane which includes the axis of rotation L5 and the axis L6 of eccentricity. Therefore, there is almost no torque applied on the electric motor 91 due to the load, hence reducing the energy required for the electric motor 91 to maintain the crankshaft holder 50 at a set pivot position.

Figure 6:
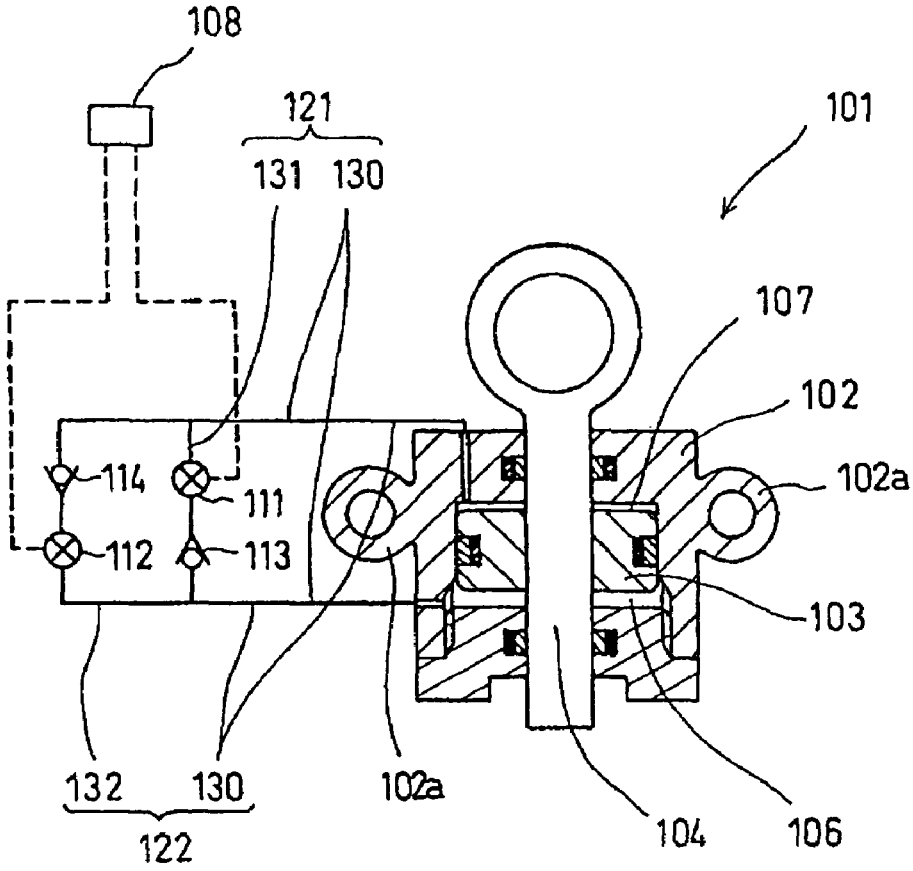
FIG. 6 is a fragmentary view of a drive system of a variable compression ratio system according to a third embodiment of the present invention.

Next, a third embodiment of the present invention is described with reference to FIG. 6. The third embodiment is partially different with respect to the drive system of the variable compression ratio system R relative to the first embodiment, but has basically the same configuration as that of the first embodiment. Therefore, for the same parts, explanations are omitted or simplified, and are made focused mainly on the differences thereof. Further, the same numerals are used, as needed, for members same as or corresponding to those used in the first embodiment.

The drive system of the variable compression ratio system R includes the oil compression actuator 101 as an actuator, and a control portion for controlling the operation of the oil compression actuator 101. The oil compression actuator 101 includes a double acting type cylinder 102, which is fixed to the first casing 1*a* on a pair of fastening portions 102*a*; a piston 103; an output rod 104 connecting the piston 103 and the crankshaft holder 50; and a connecting member 75 (see FIG. 3) whereupon the output rod 104 is pivotably mounted. A first oil pressure chamber 106 and a second oil pressure chamber 107 are formed between the cylinder 102 and the piston 103. Here, the piston 103, the output rod 104 and the connecting member 75 configure an output portion which causes a drive force to act on the crankshaft holder 50. Here, the drive force is based on the oil pressure of the operation oil in the oil pressure actuator 101.

The control portion includes an electronic control unit 108, and an oil pressure circuit which performs the supplying and discharging of the operation oil between the first oil pressure chamber 106 and the second oil pressure chamber 107. The oil pressure circuit includes piping (not shown) forming a first oil passage 121, which connects the first oil pressure chamber 106 and the second oil pressure chamber 107 and where a first on-off valve 111 and a first one-way valve 113 are disposed in series; and piping (not shown) forming a second oil passage 122, which connects the first oil pressure chamber 106 and the second oil pressure chamber 107 and where a second on-off valve 112 and a second one-way valve 114 are disposed in series. Accordingly, in the oil pressure circuit, the first one-way valve 113 and the second one-way valve 114 are mutually disposed in parallel, and the first on-off valve 111 and the second on-off valve 112 are mutually disposed in parallel. In this embodiment, parts of the first and second oil passages 121, 122 have a common oil passage portion 130 formed by common piping. The first on-off valve 111 and the first one-way valve 113, and the second on-off valve 112 and the second one-way valve 114 are respectively provided in an oil passage 131 and an oil passage 132, which are mutually disposed in parallel. However, alternatively, the first and second oil passages 121, 122 may be configured by oil passages which are separated from each other.

The electronic control unit 108 controls the first and second on-off valves 111, 112 in response to the engine driving condition and the stroke of the piston 10, and performs the supplying and discharging of operation oil between the first oil pressure chamber 106 and the second oil pressure chamber 107 by making use of a force acting on the crankshaft holder 50 from the piston 10 in the downward stroke of the piston 10 and the upward stroke thereof.

To be precise, in order to cause the crankshaft holder 50, which is placed at a swing position other than the first swing position, to occupy the first swing position, the electronic control unit 108 opens the first on-off valve 111 when the piston 10 is in an upward stroke, either a compression stroke or an exhaust stroke. When the first on-off valve 111 opens, the upward force from the piston 10, acting on the crankshaft holder 50, causes the piston 103 to discharge the operation oil in the second oil pressure chamber 107 into the first oil pressure chamber 106 through the first oil passage 121 and the first one-way valve 113, and thereby the crankshaft holder 50 swings toward the first swing position. Further, when a state where the crankshaft holder 50 arrives at the first swing position is detected by a detecting device that detects a swing position of the crankshaft holder 50, the detecting device being a potentiometer, for example, that detects the position of the output rod 104, the electronic control unit 108 closes the first on-off valve 111. At this moment, since the second on-off valve 112 is also kept closed, the supplying and discharging of the operation oil between the first and second oil pressure chamber 106, 107 is not performed. Accordingly, since the piston 103 does not move, the crankshaft holder 50 is retained at the first swing position.

Incidentally, in order to cause the crankshaft holder 50, which is placed at a swing position other than the second swing position, to occupy the second swing position, the electronic control unit 108 opens the second on-off valve 112 when the piston 10 is in a downward stroke, either an intake stroke or an expansion stroke. When the second on-off valve 112 opens, the downward force from the piston 10, acting on the crankshaft holder 50, causes the piston 103 to discharge the operation oil in the first oil pressure chamber 106 into the second oil pressure chamber 107 through the second oil passage 122 and the second one-way valve 114, and thereby the crankshaft holder 50 swings toward the second swing position. Further, when a state where the crankshaft holder 50 arrives at the second swing position is detected by the detecting device, the electronic control unit 108 closes the second on-off valve 112. At this moment, since the first on-off valve 111 is also kept closed, the supplying and discharging of the operation oil between the first and second oil pressure chamber 106, 107 is not performed, the crankshaft holder is retained at the second swing position.

In a similar manner, by causing the electronic control unit 108 to control the first and second on-off valves 111, 112, by use of the upward and downward forces of piston 10, the supplying and discharging of the operation oil between the first and second oil pressure chambers 106, 107 is performed, and the retaining of the operation oil in the first and second oil pressure chambers 106, 107 is performed. Accordingly, the crankshaft holder 50 can continuously occupy an arbitrary swing position between the first swing position and the second swing position, and thereby the compression ratio can be continuously set between the maximum compression ratio and the minimum compression ratio.

Accordingly, the third embodiment brings about the operation and effects similar to those in the first embodiment, and further brings about the following operation and effects.

Through the supplying and discharging of the operation oil stored in the first and second oil pressure chambers 106, 107, between the first and second oil pressure chambers 106, 107, a set swing position of the crankshaft holder 50 is obtained for the control portion of the actuator 101 which configures the drive system of the variable compression ratio system R. Accordingly, an oil pressure source for supplying operation oil to the first and second oil pressure chambers 106, 107 becomes unnecessary, and thereby the oil passages configuring the oil pressure circuit are simplified; the structure of the drive system of the variable compression ratio system R is downsized; an arrangement in the crank chamber 5 becomes easy; and further, since obtaining of a highly pressured operation oil eliminates the need for a pump to be activated by the power of the crankshaft 6, the power loss of the internal combustion engine E is reduced, and hence fuel consumption is improved.

As to an embodiment which is configured by modifying parts of the above-described embodiments, configurations for which changes are made are described hereinbelow.

For example, a transmission may alternatively be one other than the constant-mesh type gear transmission 40.

In the second embodiment, alternatively, the variable compression ratio system R may be configured in such a manner that the crankshaft holder 50 occupies the first swing position when the eccentric cam 94 occupies the minimum lift position; and occupies the second swing position when the eccentric cam 94 occupies the maximum lift position. Furthermore, alternatively, the range of rotation of the eccentric cam 94 may be set in a way that either one of the maximum lift position and the minimum lift position only be included in the range of rotation of the eccentric cam 94.

Further, the drive sprocket that configures the valve-use transmission system 30 may alternatively be rotatably supported on the main shaft, and may be activated by a drive member which is rotated with the crankshaft as a unit. In this case, there is almost no influence on valve timing due to the swinging of the crankshaft holder.

Still further, the power plant P may alternatively be one to be mounted on a vehicle other than a two-wheeled motor vehicle, and may be a multi-cylinder internal combustion engine.

While a working example of the present invention has been described above, the present invention is not limited to the working example described above, but various design alterations may be carried out without departing from the spirit and scope of the present invention as set forth in the claims.

What is claimed is:

1. A power plant comprising:

a crankshaft connected to a piston, the piston mounted for reciprocating motion in a cylinder via a connecting rod;

an internal combustion engine including a variable compression ratio system which permits changing of a position of an axis of rotation of the crankshaft; and a transmission including an input shaft connected to the crankshaft, wherein the power plant is configured such that the axis of rotation of the crankshaft and an axis of rotation of the input shaft are mutually disposed in parallel, wherein the variable compression ratio system includes a crankshaft holder which rotatably supports the crankshaft and which is swingably supported on the input shaft, and a drive system which swings the crankshaft holder and is connected to the crankshaft holder at a connecting portion, the connecting portion and the axis of rotation of the input shaft being disposed at one side of a plane, the plane containing the axis of rotation of the crankshaft and lying orthogonal to an axis of the cylinder, and the piston being disposed at an opposed side of the plane relative to the connecting portion and the axis of rotation of the input shaft.

2. The power plant according to claim 1, wherein the crankshaft holder comprises an oil passage which supplies lubrication oil to a crankshaft oil passage provided on the crankshaft.

3. The power plant according to claim 2, wherein the crankshaft holder comprises an oil supply passage which supplies lubrication oil into the oil passage, and an oil pump which discharges lubrication oil into the oil supply passage.

4. The power plant according to claim 1, wherein the crankshaft holder comprises an oil passage which supplies lubrication oil to an injection hole which is directed to the piston and through which lubrication oil is injected thereto.

5. The power plant according to claim 4, wherein the crankshaft holder comprises an oil supply passage which supplies lubrication oil into the injection hole, and an oil pump which discharges lubrication oil into the oil supply passage.

6. The power plant according to claim 1, wherein the connecting portion is located at a position closer to a plane which contains a cylinder axis line of the cylinder and which is in parallel with the axis of rotation of the crankshaft, than the input shaft.

7. The power plant according to claim 6, wherein the drive system includes an oil pressure actuator, and the connecting portion is provided at an output portion which applies on the crankshaft holder a drive force based on an oil pressure of operation oil of the oil pressure actuator.

8. The power plant according to claim 6, wherein the drive system includes an actuator, a rotation shaft where an eccentric cam is provided which is activated into a rotational motion by the actuator, and a linkage for linking the eccentric cam and the crankshaft holder, and wherein the actuator swings the crankshaft holder in a range of rotation which includes a maximum lift position of the eccentric cam and a minimum lift position of the eccentric cam.

9. The power plant according to claim 1, wherein a stator of an alternating current generator is fixed to the crankshaft holder, the alternating current generator including a rotor which is integrally and rotatably connected to the crankshaft.

10. The power plant according to claim 1, wherein the compression ratio can be continuously set at values between the maximum compression ratio and the minimum compression ratio.

11. A power plant comprising:

a crankshaft connected to a piston, the piston mounted for reciprocating motion in a cylinder via a connecting rod;

an internal combustion engine including a continuously variable compression ratio system which permits changing of a position of an axis of rotation of the crankshaft; and a transmission including an input shaft connected to the crankshaft, wherein the power plant is configured such that the axis of rotation of the crankshaft and an axis of rotation of the input shaft are mutually disposed in parallel, wherein the variable compression ratio system includes a crankshaft holder which rotatably supports the crankshaft and which is swingably supported on the input shaft, and a hydraulic drive system which swings the crankshaft holder and is connected to the crankshaft holder at a connecting portion, the connecting portion and the axis of rotation of the input shaft being disposed at one side of a plane, the plane containing the axis of rotation of the crankshaft and lying orthogonal to an axis of the cylinder, and the piston being disposed at an opposed side of the plane relative to the connecting portion and the axis of rotation of the input shaft.

12. The power plant according to claim 11, wherein the connecting portion is located at a position closer to a plane which contains a cylinder axis line of the cylinder and which is in parallel with the axis of rotation of the crankshaft, than the input shaft.

13. The power plant according to claim 12, wherein the hydraulic drive system includes an oil pressure actuator, and the connecting portion is provided at an output portion which applies on the crankshaft holder a drive force based on an oil pressure of operation oil of the oil pressure actuator.

14. The power plant according to claim 12, wherein the hydraulic drive system includes an oil compression actuator, the oil compression actuator comprising a piston housed within a cylinder, a first oil chamber disposed between a first side of the piston and the cylinder, and a second oil chamber disposed between a second side of the piston and the cylinder, wherein the connecting portion is provided at an output portion which applies on the crankshaft holder a drive force based on an oil pressure of operation oil of the oil pressure actuator, and wherein the operation oil moves between the first oil chamber and the second oil chamber within a closed passage.

15. A power plant comprising:

a crankshaft connected to a piston, the piston mounted for reciprocating motion in a cylinder via a connecting rod;

an internal combustion engine including a continuously variable compression ratio system which permits changing of a position of an axis of rotation of the crankshaft; and a transmission including an input shaft connected to the crankshaft, wherein the power plant is configured such that the axis of rotation of the crankshaft and an axis of rotation of the input shaft are mutually disposed in parallel, wherein the variable compression ratio system includes a crankshaft holder which rotatably supports the crankshaft and which is swingably supported on the input shaft, and an electric drive system which swings the crankshaft holder and is connected to the crankshaft holder at a connecting portion, the connecting portion and the axis of rotation of the input shaft being disposed at one a side of a plane, the plane containing the axis of rotation of the crankshaft and lying orthogonal to an axis of the cylinder, and the piston being disposed at an opposed side of the plane relative to the connecting portion and the axis of rotation of the input shaft.

16. The power plant according to claim 15, wherein the connecting portion is located at a position closer to a plane which contains a cylinder axis line of the cylinder and which is in parallel with the axis of rotation of the crankshaft, than the input shaft.

17. The power plant according to claim 16, wherein the electric drive system includes an electric motor actuator, a rotation shaft where an eccentric cam is provided which is activated into a rotational motion by the actuator, and a linkage for linking the eccentric cam and the crankshaft holder, and wherein the actuator swings the crankshaft holder in a range of rotation which includes a maximum lift position of the eccentric cam and a minimum lift position of the eccentric cam.

* * * * *